United States Patent [19]

Herrell

[11] 3,934,681

[45] Jan. 27, 1976

[54] OVERHEAD SERVICE UNIT

[75] Inventor: Robert C. Herrell, Indianapolis, Ind.

[73] Assignee: Baker-Roos, Indianapolis, Ind.

[22] Filed: Apr. 12, 1974

[21] Appl. No.: 460,510

[52] U.S. Cl. ..... 187/17; 182/63; 182/148; 187/9 E; 91/411;412

[51] Int. Cl.[2] ..... B66B 11/04

[58] Field of Search ..... 187/9, 17; 182/63, 141, 182/148; 52/115, 121; 214/670; 212/55

[56] References Cited

UNITED STATES PATENTS

| | | | |
|---|---|---|---|
| 2,106,878 | 2/1938 | Sinclair | 187/9 |
| 2,554,930 | 5/1951 | Ulinski | 187/9 X |
| 2,883,003 | 4/1959 | Arnot | 187/9 |
| 3,016,973 | 1/1962 | Williamson | 187/9 X |
| 3,143,190 | 8/1964 | Knights et al. | 187/9 |
| 3,208,556 | 9/1965 | Shaffer | 187/9 |
| 3,252,545 | 5/1966 | Quayle | 187/9 |
| 3,394,778 | 7/1968 | Brinton | 187/9 |
| 3,587,784 | 6/1971 | Tait | 187/9 |
| 3,752,261 | 8/1973 | Bushnell | 182/63 X |

*Primary Examiner*—Evon C. Blunk
*Assistant Examiner*—James L. Rowland
*Attorney, Agent, or Firm*—Jenkins, Hanley & Coffey

[57] ABSTRACT

An overhead service unit provided with a base having a fixed frame projecting upwardly therefrom. A series of movable frames are slidably interconnected to each other and to said fixed frame with a platform movably supported on one of said movable frames. A pair of cylinders are mounted on said base and are provided with a pair of rams which are movable in opposite directions to cause a plurality of chains operatively connected to said rams, the fixed and movable frames and platform to raise and lower said movable frames and platform for moving said platform to and from elevated work positions.

11 Claims, 10 Drawing Figures

OVERHEAD SERVICE UNIT

BACKGROUND OF THE INVENTION

Overhead service units in which a platform is carried upon a series of slidably interconnected frames for raising and lowering the platform have long been known in the art. One such unit is shown in U.S. Pat. No. 3,031,027.

It has been a common practice in such units to employ a single hydraulic cylinder and to interconnect the frames and platform in a series fashion. This requires that each of the movable frames be moved to effect a movement of the platform. Thus, extra power will have to be expended to move all of the movable frames even though it may be desired to raise the platform to a height less than the height of one of said frames.

It is an object of this invention to provide an overhead service unit having a platform which will be vertically movable both with, and independently of, a series of vertically movable frames, and which will permit said platform to be movable from a fully lowered position in which a workman can easily step thereon to a fully raised position in which it is adjacent the upper end of the uppermost one of said vertically movable frames.

SUMMARY OF THE INVENTION

In accordance with the preferred form of the invention, there is provided a base having a frame fixedly mounted thereon and extending upwardly therefrom. Said base is adapted to be mounted on a vehicle, such as for example, a small tractor, and is provided with a pair of laterally projecting arms having ground-engageable wheels mounted thereon. A second frame is slidably supported on said base frame; a third frame is slidably supported on said second frame; and a platform adapted to support a workman is movably supported on said third frame. Each of said second and third frames and said platform is vertically movable with and with respect to each other for moving said platform to and from elevated work stations.

In order to effect vertical movement of said platform and said second and third frames, a pair of hydraulic cylinders are mounted on said base. Each of said cylinders is provided with a vertically movable ram. The ram on one of said cylinders, which is in a vertically extended position when the platform is in its lowermost position, has a pair of sprockets operatively connected thereto which engage a first set of chains connected at one of their ends to said base frame and extending successively over sprockets mounted on said base frame, the lower end of said second frame and the upper end of said third frame with their opposite ends connected to said platform. The ram on the other of said pair of cylinders, which is in a vertically retracted position when the platform is in its lowermost position, has a pair of sprockets operatively connected thereto which engage a a second set of chains connected at their opposite ends to said base and the lower end of said second frame. Still a third set of chains have their opposite ends connected to said base frame and the lower end of said third frame with their intermediate portions engaging sprockets mounted on said second frame.

Thus, to raise the platform said one cylinder is actuated to cause its ram to vertically retract. This causes said first set of chains engaging the sprockets on said ram, base and second and third frames to raise said platform along said third frame. The other cylinder is then actuated to cause its ram to move upwardly into a vertically extended position. This causes said third set of chains engaging the sprockets on said ram to raise the second frame upwardly along the base frame. As the second frame is being raised the sprockets thereon drive the third set of chains to raise the third frame upwardly along the second frame.

As will be understood, since the third frame is connected to the second frame and the platform is connected to the third frame, upward movement of said second frame also raises the third frame with respect to the base frame, and upward movement of the third frame raises the platform with respect to second and base frames.

The cylinders are actuated to raise the frames and platform by hydraulic fluid forced into said cylinders by a pump driven by a motor controlled by a switch on the platform. The fluid is discharged from the pump through a common line, and said one cylinder for raising the platform has a lower operating pressure than the other cylinder which raises the movable frames. Thus, the platform will be raised before the frames. The fluid is evacuated from the cylinders through a solenoid valve which is connected to the switch so that said valve will open when the switch shuts off the power to the pump motor. This permits the fluid to return to the sump from both cylinders simultaneously so that the platform and the movable frames are simultaneously returned to their lowered positions.

BRIEF DESCRIPTION OF THE DRAWINGS

The accompanying drawings illustrate the invention. In such drawings.

DETAILED DESCRIPTION OF THE PREFERRED EMBODIMENT

Figure 1:
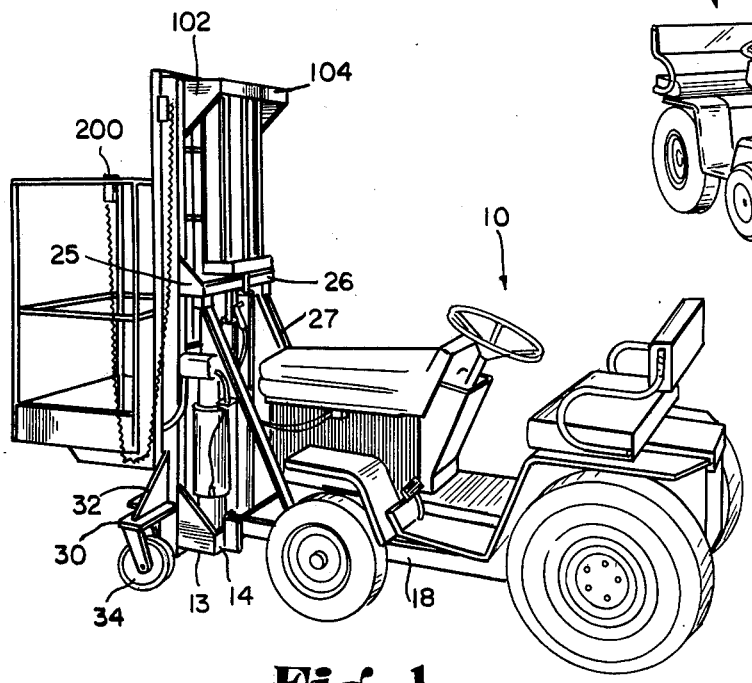
FIG. 1 is a perspective view of an overhead service unit embodying the invention and showing said unit mounted on a tractor.
Figure 5:
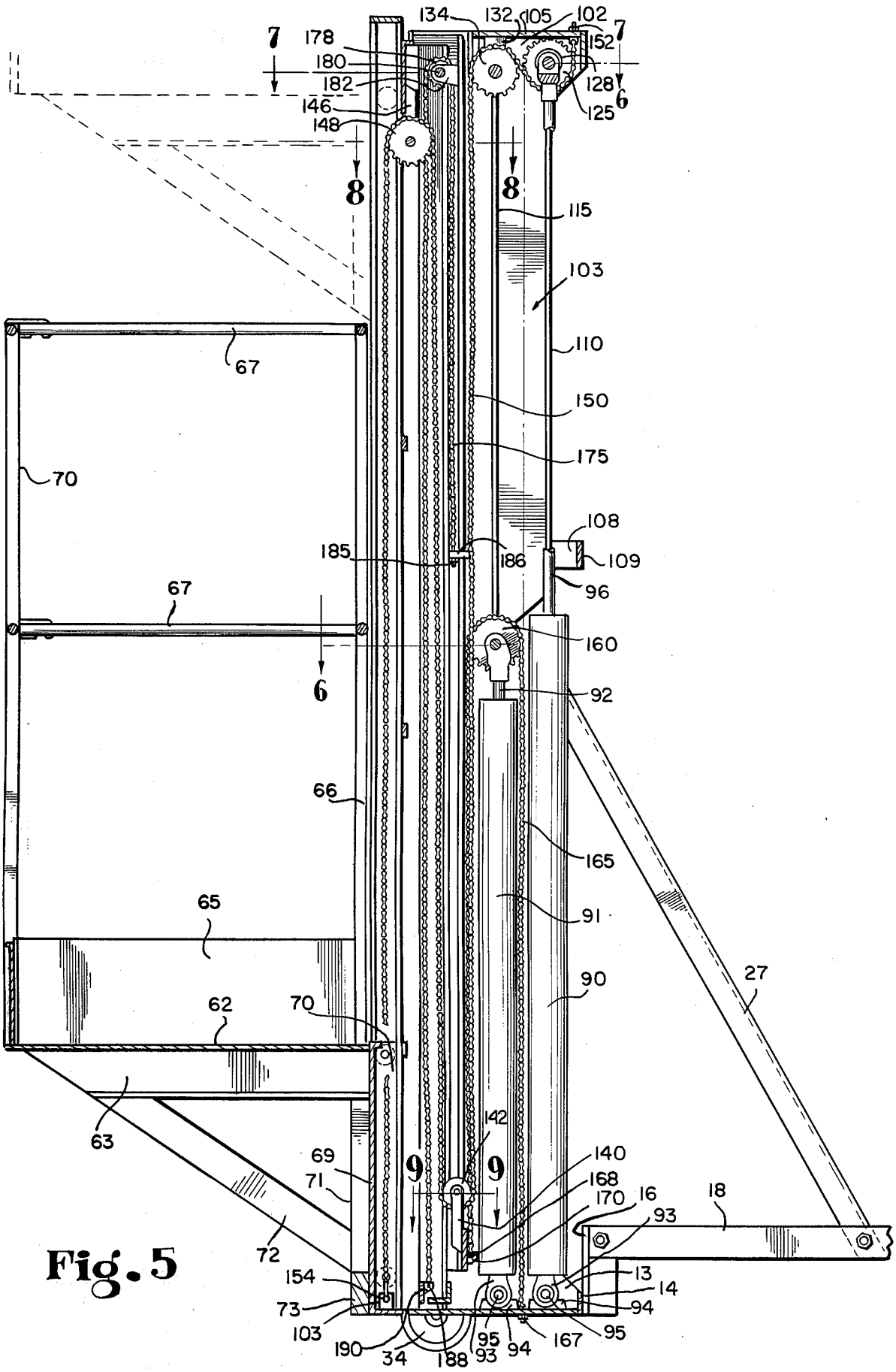
FIG. 5 is an enlarged vertical section taken on the line 5—5 of FIG. 3.

The embodiment of the invention shown in the drawings is illustrated as being connected to a conventional garden or industrial type tractor 10. As shown in FIGS. 1 and 5, the unit is provided with a base having a floor 12 to which are connected a pair of upstanding side walls 13 and rear wall 14. A pair of laterally spaced upwardly projecting arms 16 are connected to the rear wall 14. The upper ends of the arms 16 are connected to rearwardly projecting beams 18 connected at their rearward ends to the tractor frame for thus mounting the unit on said tractor.

Figure 6:
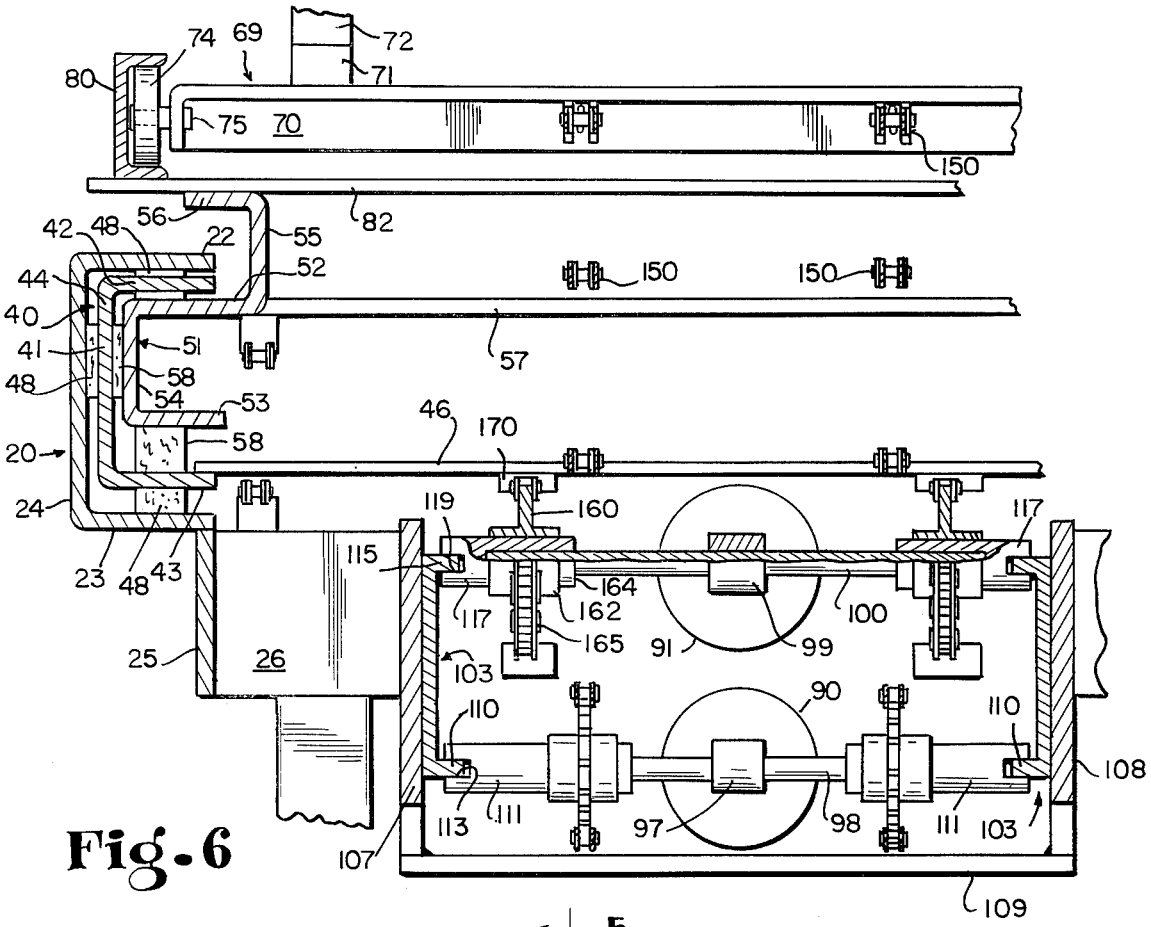
FIG. 6 is an enlarged fragmentary horizontal section taken on the line 6—6 of FIG. 5.
Figure 3:
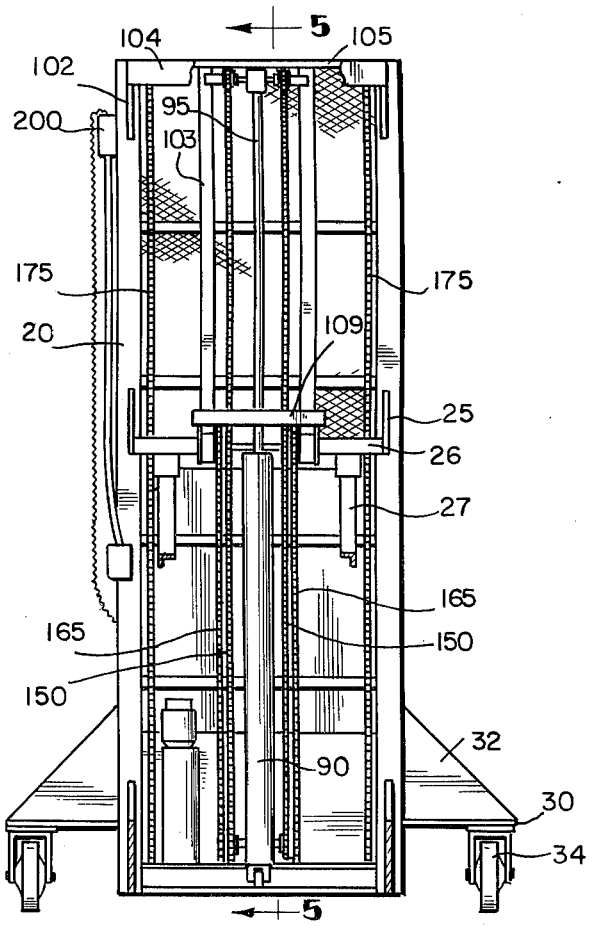
FIG. 3 is a rear elevation of the unit shown in FIG. 1, but with portions thereof being broken away.
Figure 7:
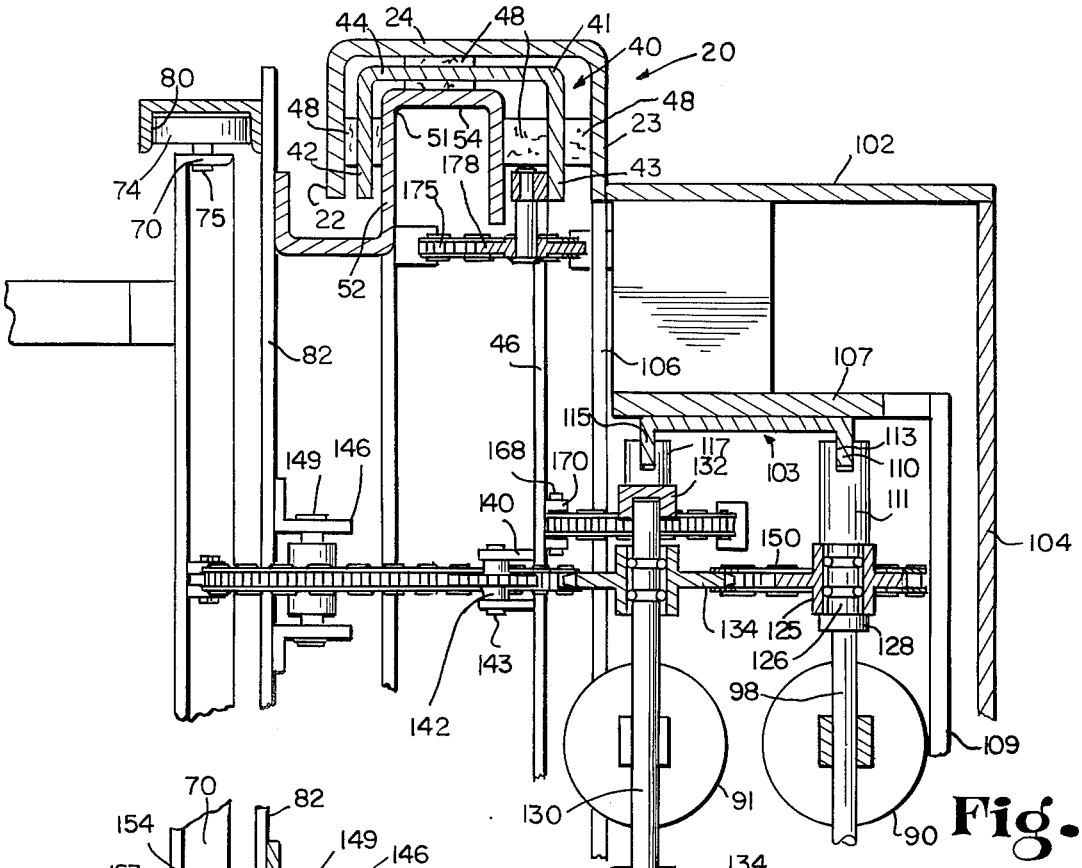
FIG. 7 is an enlarged fragmentary horizontal section taken on the line 7—7 of FIG. 5.

A first or base frame 20 is fixedly connected to the base and projects upwardly therefrom. As shown in FIGS. 6 and 7, the frame 20 comprises a pair of laterally spaced, inwardly open, opposed channels 21 each having a pair of inwardly projecting arms 22 and 23 interconnected by a web 24. The lower ends of the channel arms 22 and 23 are connected to the lateral edges of the floor 12 forwardly of the side walls 13 with the front edges of said side walls being connected to the rearward channel arms 23. A rearwardly projecting plate 25 is connected to each of the rearward channel legs 23 intermediate the height of the channel. An arm 26 extends inwardly from each of the plates 25 and is connected to a strut 27 extending obliquely downwardly therefrom for connection to one of the beams 18. Thus, the struts 27 serve to interconnect the first frame 20 to the beams 18 for bracing the frame structure.

Figure 4:
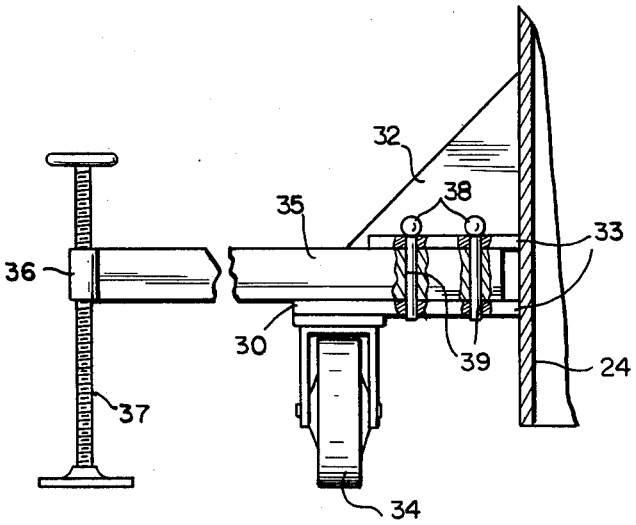
FIG. 4 is an enlarged fragmentary side elevation of one of the wheel assemblies shown in FIG. 2, but with portions thereof being broken away and showing an outrigger mounted thereon.

As shown in FIGS. 1 and 4, a pair of arms 30 project laterally outwardly from the channel webs 24 adjacent the lower ends thereof. Each of the arms 30 is braced by a triangular plate 32 connected to said arm and the adjacent channel web 24. A ground-engageable wheel 34 is mounted on each of said arms adjacent the outer end thereof. Each of the wheels 34 is connected to its associated arm by a conventional caster-type mounting in order to permit said wheels to swivel about vertical axes and thus facilitate turning during movement of the tractor 10.

As shown in FIG. 4, a pair of horizontally disposed parallel flanges 33 project forwardly from the front faces of each of the arms 30 and plates 32. A pair of outrigger beams 35 are removably received between the sets of flanges 33 and project laterally outwardly from the opposite sides of the unit. Each of the beams 35 has a socket 36 at its outer end in which a vertically extending foot 37 is received. Said socket and foot are provided with matingly engageable threads for vertically adjusting the position of the foot to bring it into a ground-engaging position for stabilizing the unit at the work location. The beams 35 are releasably locked in position between their respective sets of flanges 33 by pairs of pins 38 received in vertically aligned openings 39 in the flanges 33 and beams 35.

A second frame 40 is slidably carried in the first frame 20. As best illustrated in FIGS. 6 and 7, the frame 40 comprises a pair of laterally spaced, opposed, inwardly open channels 41 each having a pair of inwardly projecting legs 42 and 43 interconnected at their outer ends by a web 44. The channels 41 are cross-braced by a plurality of vertically spaced crossbars 46 connected at their outer ends to the forwardly presented faces of the rearwardly disposed channel legs 43. As shown in FIG. 7, vertically extending wear pads 48 are mounted on the inner faces of the legs 22 and 23 and webs 24 on the first frame channels 21 and engage the outwardly presented faces of legs 42 and 43 and web 44 on the second frame channels 41 to locate the channels 41 in the chanels 21 and reduce the frictional contact therebetween.

Still a third frame 50 is slidably carried by the second frame 40. Frame 50 comprises a pair of laterally spaced, opposed, generally S-shaped channels 51 each having a pair of inwardly projecting legs 52 and 53 interconnected by a web 54 at the outer ends thereof. The forwardly presented channel leg 52 is also connected at its inner end to a web 55 set inwardly from the inner ends of the forwardly presented channel legs 22 and 42 and connected at its forward end to a laterally outwardly projecting leg 56. As shown, the channels 51 of frame 50 are cross-braced by a plurality of vertically spaced transversely extending crossbars 57 connected to the webs 55. In order to locate the channels 51 in channels 41 and reduce the frictional contact therebetween, vertically extending wear pads 58 are mounted on the inwardly presented faces of the channel legs 42 and 43 and webs 44 which engage the outwardly presented faces of the channel legs 52 and 53 and webs 54.

A platform 60 is movably carried on the frame 50. Said platform comprises a horizontally disposed floor 62 mounted on a support frame 63. As shown, kick plates 65 are connected to the floor 62 at its periphery and project upwardly from the sides and rear thereof. A plurality of posts 66 extend vertically upwardly from the corners of the floor 62, and are interconnected at the sides and rear of the platform assembly by a plurality of vertically spaced horizontally extending rails 67. A gate 68 is swingably mounted on one of the front posts 66 to permit access to the cage formed by the posts 66 and rails 67.

In order to movably mount the platform on the frame 50 a plate 69 haing a rearwardly projecting peripheral skirt 70 extends downwardly from platform floor 62 at the rear thereof. A pair of laterally spaced ribs 71 are mounted on the front face of plate 69, and a pair of braces 72 interconnect said ribs to the support frame 63. Two pairs of vertically spaced stub axles 75 are mounted on the lateral stretches of the plate skirt 70 and carry pairs of rollers disposed laterally outwardly from the opposed sides of said plate. As shown in FIG. 7, the rollers 74 are received in a pair of opposed, vertically extending tracks 80 mounted on a series of cross-bars 82 connected to the legs 56 on frame channels 51 for thus movably interconnecting the platform 60 to frame 50.

Figure 2:
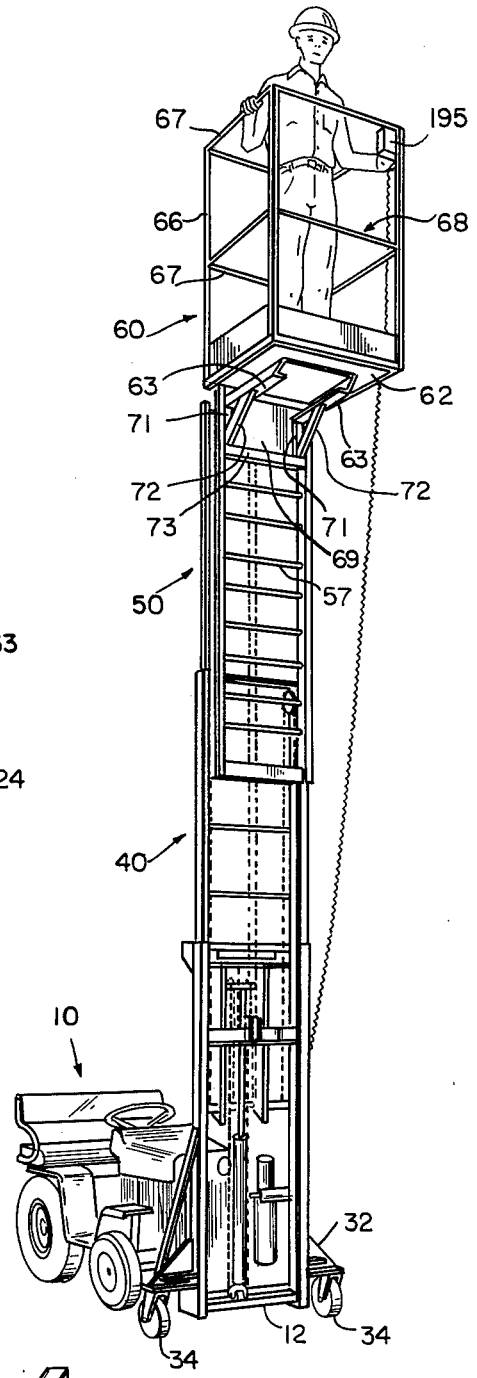
FIG. 2 is a perspective view of the unit shown in FIG. 1, but showing said unit in a raised position.

The frames 40 and 50 and platform 60 are movable between their fully retracted positions as shown in FIG. 1 and their fully extended positions as shown in FIG. 2. The power source for raising said frames and platform comprises a pair of hydraulic cylinders 90 and 91, the cylinder 90 having a lower operating pressure than cylinder 91. The cylinders are mounted in longitudinally spaced relationship on the base floor 12 as by yokes 93 on their lower ends swingably and slidably carried on pins 95 received in brackets 94 mounted on the base floor 12. As shown in FIGS. 6 and 7, cylinder 90 has a ram 96 projecting upwardly therefrom and fixedly connected at its upper end by a bracket 97 to a transversely extending axle 98. Similarly, cylinder 91 has an upwardly projecting ram 92 connected by a bracket 99 to a transversely extending axle 100.

As shown in FIG. 7, a pair of wings 102 project rearwardly from the legs 23 of frame channels 21 and are interconnected at their rear ends by a transversely extending plate 104. A cover plate 105 is connected to the upper ends of the frame channels 21 and extends rearwardly therefrom and is connected to the upper edges of the wings 102 and plate 104. The plate 104 is also connected to a cross-bar 106 interconnecting the legs 23 on frame channels 21 by a pair of laterally spaced arms 107. As shown in FIG. 7, a second pair of arms 108 in vertical alignment with the arms 107 project rearwardly from the plates 26 and are interconnected at their rearward ends by a transversely extending plate 109.

A pair of opposed, inwardly open channels 103 are connected to the inner faces of the plate arms 107 and 108 and extend vertically therebetween. The rearwardly disposed legs on the channels 103 form a pair of guides 110 in alignment with the axle 98, and the forwardly disposed legs on said channels form a pair of guides 115 in alignment with the axle 100. As shown in FIGS. 6 and 7, a slide 111 is mounted on each end of the axle 98 and is provided with an outwardly open slot 113 at its outer end which is slidably received on the adjacent guide 110. In a like manner, a slide 117 is mounted on each end of axle 100 and is provided with a slot 119 at its outer end slidably received on the adjacent guide 115. Thus, the guides 110 and 115 cooperate with the slides 111 and 117 for guiding the vertical movements of the axles 98 and 100 upon actuation of cylinders 90 and 91. With the cylinders 90 and 91 being slidably and swingably mounted on the pins 95, said cylinders are movable to compensate for any misalignment of the slides and guides and thereby prevent the rams 92 and 96 from bending or binding up in the cylinders.

The platform 60 is vertically movable along the front face of the frame 50 upon vertical movement of the axle 98. The transmission of this vertical axle movement to the platform is accomplished by a series of cooperating sprockets and chains which will now be described. A pair of laterally spaced sprockets 125 are mounted on bearings 126 carried on the axle 98. The bearings 126, and thus the sprockets 125, are retained in a fixed axial position on the axle 98 by collars 128 bearing against the inwardly presented faces of said sprockets and bearings and retaining their outer faces in engagement with the guides 111. As shown in FIG. 7, a transversely extending axle 130 is rotatably carried in a pair of bearing blocks 132 mounted on the bottom face of the cover plate 105. A pair of sprockets 134 are fixedly mounted on the axle 130 for rotation therewith. As shown, the sprockets 134 are mounted axially along the length of the axle 130 to dispose said sprockets in fore and aft alignment with the sprockets 125 on axle 98.

Figure 9:
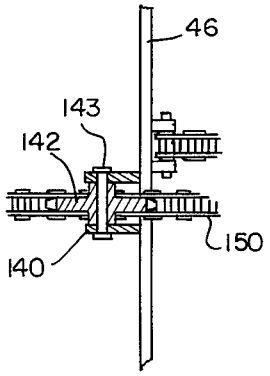
FIG. 9 is an enlarged fragmentary horizontal section taken on the line 9—9 of FIG. 5.

As shown in FIGS. 5 and 9, two pairs of laterally spaced ears 140 are mounted on one of the cross-bars 46 adjacent the lower ends of the frame channels 41. A sprocket 142 is rotatably connected to each of the pairs of ears 140 by a pin 143. As shown in FIG. 7, the sprockets 142 are mounted along the length of the cross-bar 46 in the same vertical planes as the sprockets 125 and 134.

Figure 8:
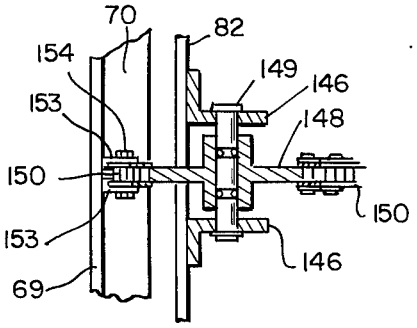
FIG. 8 is an enlarged fragmentary horizontal section taken on the line 8—8 of FIG. 5.

As shown in FIGS. 5 and 8, two pairs of ears 146 are mounted on a cross-bar 82 interconnecting the frame channels 51 adjacent the upper ends thereof. A sprocket 148 is rotatably connected to each pair of ears by a pin 149. Again, as shown in FIG. 7, the sprockets 148 lie in the same vertical planes as the sprockets 142, 134, and 125.

The cylinder 90 is operatively connected to the platform 60 by a pair of chains 150. As best shown in FIG. 5, each of the chains 150 is fixedly connected at one of its ends to the cover plate 105 by a bracket 152 threadably connected to said plate. From its connection at 152, each of the chains 150 extends successively over the sprockets 125, 134, 142, and 148. The ends of the chains 150 opposite the cover plate 105 are fixedly connected to a pair of flanges 103 on the bottom stretch of platform plate skirt by a bolt 154. Thus, upon a downward retracting movement of the ram 96, the axle 98 will move downwardly with its slides 111 moving along guides 110. This causes the sprockets 125 to move the section of the chains 150 between the sprockets 134 and their connections 152 move downwardly so that said chains will exert an upward pull on the platform moving it upwardly with respect to the frames 20, 40, and 50. Conversely, when the ram 96 is permitted to move upwardly into an extended position, the sprockets 125 will permit the chains 150 to move into the position shown in FIG. 5 so that the platform will be in its lowered position on frame 50.

The cylinder 91 is operatively connected to the frame 40 by a second set of sprockets and chains. As shown in FIG. 6, a pair of sprockets 160 are mounted on a pair of bearings 162 in a fixed axial position along the axle 100 by a pair of collars 164 abutting the inner faces of said bearings and sprockets and retaining the outer faces of said bearings and sprockets in abutting engagement with the slides 117. As shown in FIG. 6, the sprockets 160 are disposed in vertical planes located laterally outwardly from the vertical planes in which sprockets 125, 134, 142 and 143 lay.

A pair of chains 165 extend over the sprockets 160. One end of the chains 165 is fixedly connected to the base floor 12 by a bracket 167 threadably connected to said floor. The opposite ends of said chains are fixedly connected to the frame 40 by bolts 168 mounted on laterally spaced pairs of ears 170 on the cross-bar 46 at the lower ends of the frame channels 41.

Still a third pair of chains 175 interconnect the frames 20 and 50. The chains 175 extend over a pair of sprockets 178 rotatably mounted on pins 180 carried in a pair of ears 182 on the cross-bar 46 interconnecting the frame channels 41 at the upper ends thereof. As shown in FIG. 7, the sprockets 178 lie in vertical planes disposed laterally outwardly from the vertical planes of the sprockets 160. The chains 175 are fixedly connected at one of their ends, as by a pair of bolts 185, to laterally spaced pairs of ears 186 projecting forwardly from the plates 26 on frame 20. The opposite ends of the chains 125 are connected, as by a pair of bolts 188, to laterally spaced pairs of ears 190 projecting rearwardly from the cross-bar 57 interconnecting the frame channels 51 at the lower ends thereof.

Thus, upon upward movement of the ram 92, the axle 100 will move upwardly with its slides 117 moving along the guides 115. During such upward movement of the axle 100, the sprockets 160 will drive the chains 165 to raise the frame 40 upwardly with respect to the frame 20. As the frame 40 is moved upwardly, its sprockets 178 will drive the chains 175 to thus cause said chains to move the frame 50 upwardly with respect to the frame 40. Thus, as will be understood, the frame 40 is movable with respect to frame 20; frame 50 is movable with and with respect to frame 40; and platform 60 is movable with and with respect to frames 40 and 50.

Figure 10:
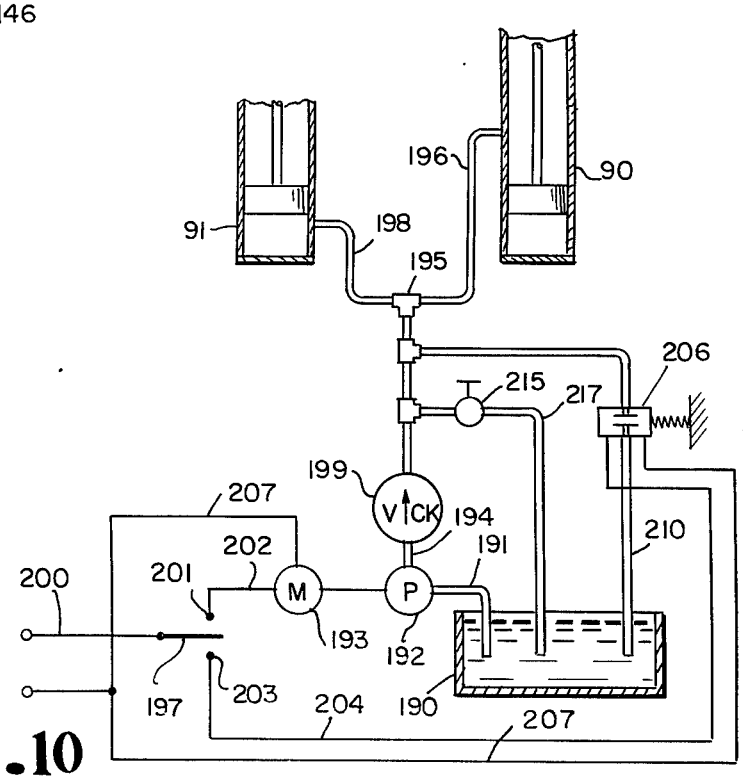
FIG. 10 is a diagrammatic view of the hydraulic system for the unit shown in FIG. 1.

The fluid for the cylinders 90 and 91 is supplied by a sump and pump-motor unit mounted on the base floor 12. As shown in FIG. 10, the fluid is pumped from the sump 190 through the inlet 191 of the pump 192 driven by the motor 193 which is actuated by a three-way switch 197 carried on the platform 60. The pump outlet is connected to a conduit 194 which in turn is connected by a T-joint 195 to a pipe 196 connected to the upper end of cylinder 90 and to a pipe 198 connected to the lower end of cylinder 91. As shown, a check valve 199 is mounted in the conduit 194 to prevent the return flow of fluid through the motor 193.

The hydraulic pressure necessary to move ram 96 of cylinder 90 is less than the pressure required to move ram 92 in cylinder 91. Thus, as fluid moves through the conduit 194, the ram 96 will first be moved to cause platform 60 to move vertically upwardly on frame 50. After the ram 96 has moved through its full stroke, the fluid pressure on ram 92 of cylinder 91 will cause said ram to move the frames 40 and 50 upwardly with respect to the frame 20. Because of this pressure differential required to actuate the cylinders, when the motor is deenergized and the fluid is permitted to return to the sump 190 it will return from both cylinders simultaneously so that the platform 60 and frames 40 and 50 all return to the lowered positions at the same time. As will be understood, if it is desired to raise the platform 60 to a height less than the height of the retracted frames, cylinder 91 will not be actuated and said frames will not be raised from their lowered position shown in FIG. 5.

As shown, the switch 197 is connected by a line 200 to an electrical power source (not shown) and is closable against a contact 201 on line 202 leading to one side of the motor 193. Said switch is also closable against a contact 203 on line 204 connected to one side of a single ended solenoid valve 206 with a spring return. As shown, the sides of the motor and valve opposite lines 202 and 204 are connected by lines 207 to the power source. The valve 206 is mounted in a pipe 210 interconnecting the sump 190 with the conduit 194 downstream of check valve 199.

Thus, with the switch 197 closed against contact 201 the motor 193 will be energized to drive pump 192 to raise the platform and/or the platform and frames 40 and 50 while the valve 206 remains closed. Once the platform is at the desired elevation, switch 197 is moved to its open position shown in FIG. 10, to open both contacts 201 and 203 so that the platform will remain at that elevation. When it is desired to lower the platform, switch 197 is closed against contact 203 to open the valve 206 while the motor 193 remains deenergized. This permits the fluid from cylinder 91 to flow back into the sump 190. Concurrently, with pressure removed from pipe 196 and the valve 206 open, the ram 96 of cylinder 90 will be pulled upwardly by the weight of the platform 60 acting through chains 150. Thus, the fluid in cylinder 90 will be expelled through pipes 196 and 210 back into sump 190. With the fluid removed from the cylinders, the frames 40 and 50 and platform 60 will be in their lowered retracted positions so that a worker can easily step onto or down from said platform.

A manually controlled by-pass valve 215 is mounted in a pipe 217 interconnecting the sump 190 and conduit 194 downstream of check valve 199. Thus, in the event of a power failure which would prevent the solenoid valve 206 from opening, valve 215 can be manually opened to permit the fluid in cylinders 90 and 91 to return to the sump 190 through pipe 217 so that the platform 60 and frames 40 and 50 can be lowered into their retracted positions.

While the unit has been shown and described as being mounted on the tractor 10, it is to be understood, however, that it can be mounted on any desired type of device or vehicle without departing from the spirit and scope of the claims appended hereto.

I claim:

1. An overhead service unit, comprising a base, a first frame fixedly mounted on said base and projecting upwardly therefrom, a plurality of second frames slidably interconnected to each other and to said first frame, a platform movably mounted on one of said second frames, a pair of cylinders mounted on said base and each having an upwardly projecting vertically movable ram, a plurality of sets of chains operatively connected to said base, first and second frames, platform and rams whereby upon actuation of said cylinders to extend one of said rams and retract the other of said rams said chains will cause said second frames and platform to move vertically with and with respect to each other, and means for selectively actuating said cylinders to move said rams with respect to each other.

2. An overhead service unit, comprising a base, a first frame fixedly mounted on said base and projecting upwardly therefrom, a plurality of second frames slidably interconnected to each other and to said first frame, a platform movably mounted on one of said second frames, a pair of cylinders mounted on said base and each having an upwardly projecting vertically movable ram, an axle mounted on each of said rams for movement therewith, guide means mounted on said first frame, slide means mounted on said axles and engageable with said guide means for guiding the movements of said axles, a plurality of sprockets mounted on said axles and first and second frames, and a plurality of chains connected to said base, first frame, one of said second frames and platform and received on said sprockets whereby actuation of said cylinders to extend one of said rams and retract the other of said rams will cause said rams to move said axles in opposite directions and cause said chains to move said frames and platform vertically with and with respect to each other.

3. An overhead service unit as set forth in claim 2 in which each of said cylinders is movably connected to said base.

4. An overhead service unit, comprising a base, a first frame fixedly mounted on said base and projecting upwardly therefrom, a plurality of second frames slidably interconnected to each other and to one side of said first frame, a pair of vertically extending tracks mounted on one of said second frames at the side of said second frames opposite said first frame, a platform, a plurality of rollers mounted on said platform and carried in said tracks for supporting said platform in said tracks, a pair of cylinders mounted on said base and each haing an upwardly projecting vertically movable ram, a plurality of sets of chains operatively connected to said base, first and second frames, platform and rams whereby upon actuation of said cylinders to extend one of said rams and retract the other of said rams said chains will cause said second frames and platform to move vertically with and with respect to each other, and means for selectively actuating said cylinders to move said rams with respect to each other.

5. An overhead service unit as set forth in claim 4 in which each of said first and second frames comprises a pair of interfitting channels, and pluralities of vertically spaced crossmembers interconnect the channels of each frame.

6. An overhead service unit as set forth in claim 4 in which said platform is provided with a floor, a vertically extending plate is interconnected to said floor at the side thereof adjacent said tracks, and said rollers and one of said sets of chains are connected to said plate.

7. An overhead service unit, comprising a base; a first frame fixedly mounted on said base and extending upwardly therefrom; a second frame slidably interconnected to said first frame; a third frame slidably interconnected to said second frame; a platform movably carried on said third frame; a first cylinder having a ram projecting upwardly therefrom and mounted on said base; a second cylinder having a ram projecting upwardly therefrom and mounted on said base; sprocket means interconnected to each of said rams, the upper ends of said first and third frames, and the upper and lower ends of said second frame; first chain means connected to said first frame and platform and extending over the sprocket means on said first cylinder ram, first and third frames, and the lower end of said second frames; second chain means connected to said base and second frame and extending over the sprocket means on said second cylinder ram; third chain means connected to said first and third frames and extending over the sprocket means on said second frame; said cylinders being actuatable to cause said first, second, and third chain means to move said second and third frames, and said platform vertically with and with respect to each other.

8. An overhead service unit as set forth in claim 7 in which each of said rams is connected to an axle, guide means are mounted on said first frame for guiding the movements of said axles, and said axles have said sprocket means mounted thereon.

9. A platform assembly, comprising a base, a first frame fixedly mounted on said base and projecting upwardly therefrom, a plurality of second frames slidably interconnected to each other and to said first frame, a platform slidably connected to one of said second frames and projecting outwardly therefrom, a pair of cylinders mounted on said base in longitudinally spaced relationship and each having an upwardly projecting vertically movable ram, an axle connected to each of said rams, pairs of laterally spaced guides interconnected to said first frame, slides mounted on the ends of said axles and slidably received on said guides, a plurality of sprockets mounted on said axles, and first and second frames, and a plurality of chains operatively connected to first and second frames, platform and base and received over said sprockets whereby upon actuation of said cylinders to extend one of said rams and retract the other of said rams said chains will cause said second frames and platform to move vertically with respect to each other.

10. An overhead service unit, comprising a base, a first frame fixedly mounted on said base and projecting upwardly therefrom, a plurality of second frames slidably interconnected to each other, one of said second frames being slidably connected to said first frame, a platform movably supported on another of said second frames and projecting outwardly therefrom, first chain means connected to said first frame and platform and operatively connected to said second frames, second chain means connected to said base and said one of said second frames, third chain means connected to said first frame and said other of said second frames and operatively connected to said one of said second frames, and means for moving said first and second chain means to cause said first, second and third chain means to move said platform and second frames vertically with and with respect to each other.

11. An overhead service unit as set forth in claim 10 in which said means for moving said first and second chain means comprises a first cylinder having a ram operatively connected to said first chain means and a second cylinder having a ram operatively connected to said second chain means.

* * * * *